US005511696A

United States Patent [19]

Gustafson

[11] Patent Number: 5,511,696

[45] Date of Patent: Apr. 30, 1996

[54] TUBE SQUEEZER AND WINDER APPARATUS

[76] Inventor: Herbert A. Gustafson, 210 Belgo Rd., Lakeville, Conn. 06039-1003

[21] Appl. No.: 341,658

[22] Filed: Nov. 17, 1994

[51] Int. Cl.[6] ..... B65D 35/28

[52] U.S. Cl. ..... 222/102

[58] Field of Search ..... 222/100, 101, 222/102

[56] References Cited

U.S. PATENT DOCUMENTS

| | | | |
|---|---|---|---|
| Des. 341,050 | 11/1993 | Waffensmith . | |
| 2,642,205 | 6/1953 | Lane | 222/102 X |
| 3,586,213 | 6/1971 | Gill . | |
| 3,701,459 | 10/1972 | Ward . | |
| 4,624,394 | 11/1986 | Ushiro . | |
| 5,102,014 | 4/1992 | Yanagisawa et al. | 222/100 |
| 5,248,065 | 9/1993 | Zima . | |
| 5,263,610 | 11/1993 | Okamura et al. | 222/100 |

*Primary Examiner*—Gregory L. Huson

[57] ABSTRACT

A tube squeezer apparatus includes a base member and a first squeezer/winder support member connected to a first side of the base member. A second squeezer/winder support member is connected to a second side of the base member. The first side and the second side of the base member are at opposite sides of the base member. A first squeezer and a second squeezer are connected between the first squeezer/winder support member and the second squeezer/winder support member. The first squeezer and the second squeezer include ends for connection to the first squeezer/winder support member and the second squeezer/winder support member. A winder shaft assembly is connected between the first squeezer/winder support member and the second squeezer/winder support member. The first squeezer/winder support member may include a plurality of lock notches arrayed in a circular pattern adjacent to a shaft portion of the winder shaft assembly. The shaft portion of the winder shaft assembly includes a plurality of lock protuberances arrayed in a circular pattern on the shaft portion, such that the lock protuberances are adapted to be placed in registration with the lock notches.

9 Claims, 3 Drawing Sheets

TUBE SQUEEZER AND WINDER APPARATUS

BACKGROUND OF THE INVENTION

1. Field of the Invention

The present invention relates generally to dispensers and, more particularly, to dispenser devices especially adapted for dispensing material from squeeze tubes.

2. Description of the Prior Art

Many popular products are contained in squeeze tubes and dispensed therefrom. One problem associated with squeeze tubes, however, is incomplete removal of the contents of the tube. Very often a squeeze tube is grasped near the top of the tube near the dispensing outlet, and a considerable portion of the contained material remains at the opposite end of the squeeze tube. To prevent this problem from occurring, it is highly recommended that a squeeze tube be grasped and squeezed from the end opposite to the outlet. Nevertheless, in every day practice, this is often not done.

Throughout the years, a number of innovations have been developed relating to devices for squeezing out the contents of squeeze tubes, and the following U.S. Pat. Nos. are representative of some of those innovations: 3,701,459; 4,624,394; 5,102,014; 5,248,065; and Des. 341,050. More specifically, U.S. Pat. No. 3,701,459 discloses a tube squeezer device that employs a pair of rollers operated by a hand crank. The tube is squeezed between the handcranked rollers, and springs are used to feed the squeeze tube between the rollers. Moreover, the device disclosed in this patent is wall mounted. In terms of accessibility and convenience, it would be desirable if a device for squeezing the contents out of squeeze tubes were not wall mounted. In addition, it would be desirable if a device for squeezing the contents out of squeeze tubes did not employ a hand crank.

U.S. Pat. No. 4,624,394 discloses a hand-squeezed trigger mechanism and complex linkage for squeezing out the contents of squeeze tubes. Such a device takes up a considerable amount of space and is quite complex. In this respect, it would be desirable if a device for squeezing the contents out of squeeze tubes does not take up a considerable amount of space and is simple in structure.

U.S. Pat. No. 5,102,014 discloses a tube squeezer that employs meshed gears for winding the rear portion of a squeeze tube on a winding shaft. To avoid complexities and expense involved with the manufacture and use of meshed gears, it would be desirable if a device for squeezing the contents out of squeeze tubes did not employ meshed gears.

U.S. Pat. No. 5,248,065 discloses a tube squeezer that employs a flat base plate and two flat squeeze plates. Such a device requires periodic loosening and retightening of the two flat plates as the contents of the squeeze tube are squeezed out of the tube. In this respect, it would be desirable if a device for squeezing the contents out of squeeze tubes were provided which did not require periodic loosening and retightening of flat plates against a flat base.

U.S. Pat. No. Des. 341,050 discloses a tooth paste tube squeezer that employs a slotted winding shaft that is not attached to any support. It is noted that some squeeze tubes are made from metal materials which have little resiliency. When such a tube is squeezed, the tube tends to remain in its last-squeezed orientation. The tube squeezer disclosed in this design patent may be well suited for such a metal squeeze tube. However, there are other squeeze tubes that are made from plastic materials, and such plastic materials have great resiliency. When such a plastic tube is squeezed, the tube tends to return to its non-squeezed condition. With such a plastic tube, the tube squeezer disclosed in this design patent would not be readily usable. In this respect, it would be desirable if a device for squeezing the contents out of squeeze tubes were readily usable with resilient plastic squeeze tubes.

Still other features would be desirable in a tube squeezer apparatus. For example, when a resilient squeeze tube is employed on a winding shaft, it would be desirable for a tube squeezer apparatus to lock a winding shaft supporting a partially squeezed tube into a partially squeezed position to prevent the resilient squeeze tube from unwinding the winding shaft.

It is well known that some persons are right handed, and some persons are left handed. In this respect, it would be desirable if a device for squeezing the contents out of squeeze tubes were provided that is readily used by both right handed and left handed persons.

Thus, while the foregoing body of prior art indicates it to be well known to use devices for squeezing dispensing tubes, the prior art described above does not teach or suggest a tube squeezer apparatus which has the following combination of desirable features: (1) is not wall mounted; (2) does not employ a hand crank; (3) does not take up a considerable amount of space and is simple in structure; (4) does not employ meshed gears as the tube is squeezed; (5) does not require periodic loosening and retightening of flat plates against a flat base; (6) is readily usable with resilient plastic squeeze tubes; (7) locks a winding shaft supporting a partially squeezed tube into a partially squeezed position to prevent the resilient squeeze tube from unwinding on the winding shaft; and (8) is readily used by both right handed and left handed persons. The foregoing desired characteristics are provided by the unique tube squeezer apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a tube squeezer apparatus which includes a base member and a first squeezer/winder support member connected to a first side of the base member. The first squeezer/winder support member includes a first squeezer connection position, a second squeezer connection position, and a winder connection position. A second squeezer/winder support member is connected to a second side of the base member. The first side and the second side of the base member are at opposite sides of the base member. The second squeezer/winder support member includes a first squeezer connection position, a second squeezer connection position, and a winder connection position. A first squeezer is connected between the first squeezer connection position of the first squeezer/winder support member and the first squeezer connection position of the second squeezer/winder support member. A second squeezer is connected between the second squeezer connection position of the first squeezer/winder support member and the second squeezer connection position of the second squeezer/winder support member. The first squeezer and the second squeezer include ends for connection to the first squeezer/winder support member and the second squeezer/ winder support member. A winder shaft assembly is connected between the winder connection position of the first squeezer/winder support member and the winder connection position of the second squeezer/winder support member. The winder shaft assembly includes a shaft portion, adapted to support a squeezable tube, and a handle, connected to the shaft portion, for turning the shaft portion. The shaft portion includes a slot portion adapted to receive an end of the squeezable tube.

The base member, the first roller/winder support member, and the second roller/winder support member are in the form of a unified, integrated structure. Each of the first squeezer/winder support member and the second squeezer/winder support member includes a squeezer-receiving aperture for receiving an end of the first squeezer, a squeezer-receiving aperture for receiving an end of the second squeezer, and a winder-receiving aperture for receiving an end of the shaft portion of the winder shaft assembly. The squeezer-receiving apertures are circular and provide bearing surfaces for a cylindrical first squeezer and a cylindrical second squeezer, thereby permitting the first squeezer and the second squeezer to roll with respect to the first squeezer/winder support member and the second squeezer/winder support member. Also, the winder-receiving apertures are circular and provide bearing surfaces for a cylindrical shaft portion of the winder shaft assembly to roll with respect to the first squeezer/winder support member and the second squeezer/winder support member when the handle of the winder shaft assembly is turned.

The first squeezer/winder support member and the second squeezer/winder support member project perpendicularly upward from the base member, whereby the first squeezer/winder support member and the second squeezer/winder support member are substantially parallel to each other.

The first squeezer and the second squeezer are spaced apart from each other by a predetermined distance such that a squeezable tube is squeezed between the first squeezer and the second squeezer when the squeezable tube is pulled as it is positioned between the first squeezer and the second squeezer. The respective ends of the first squeezer and the second squeezer include slots. The winder connection position lies on a perpendicular bisector of a line segment between the first squeezer connection position and the second squeezer connection position.

The winder connection positions on the first and second squeezer/winder support members are located sufficient distances from the first squeezer connection positions and the second squeezer connection positions on the first and second squeezer/winder support members, such that a squeezed and winded tube con be supported on the winder shaft assembly between the first and second squeezer/winder support members directly above the base member.

The first squeezer/winder support member includes at least one lock notch, and the winder shaft assembly includes at least one lock protuberance adapted to fit into the lock notch for locking the winder shaft assembly in a selected position with respect to the first squeezer/winder support member.

The first squeezer/winder support member includes a plurality of lock notches arrayed in a circular pattern on the first squeezer/winder support member adjacent to the first squeezer connection position around the shaft portion of the winder shaft assembly. The shaft portion of the winder shaft assembly includes a plurality of lock protuberances arrayed in a circular pattern on the shaft portion, such that the lock protuberances are adapted to be placed in registration with the lock notches.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tube squeezer apparatus which has all of the advantages of the prior art and none of the disadvantages.

It is another object of the present invention to provide a new and improved tube squeezer apparatus which may be easily and efficiently manufactured and marketed.

It is a further object of the present invention to provide a new and improved tube squeezer apparatus which is of durable and reliable construction.

An even further object of the present invention is to provide a new and improved tube squeezer apparatus which is susceptible of a low cost of manufacture with regard to both materials and labor, and which accordingly is then susceptible of low prices of sale to the consuming public, thereby making such tube squeezer apparatus available to the buying public.

Still yet a further object of the present invention is to provide a new and improved tube squeezer apparatus which is not wall mounted.

Still another object of the present invention is to provide a new and improved tube squeezer apparatus that does not employ a hand crank.

Yet another object of the present invention is to provide a new and improved tube squeezer apparatus which does not take up a considerable amount of space and is simple in structure.

Even another object of the present invention is to provide a new and improved tube squeezer apparatus that does not employ meshed gears as the tube is squeezed.

Still a further object of the present invention is to provide a new and improved tube squeezer apparatus which does not require periodic loosening and retightening of flat plates against a flat base.

Yet another object of the present invention is to provide a new and improved tube squeezer apparatus that is readily usable with resilient plastic squeeze tubes.

Still another object of the present invention is to provide a new and improved tube squeezer apparatus which locks a winding shaft supporting a partially squeezed tube into a partially Squeezed position to prevent the resilient squeeze tube from unwinding on the winding shaft.

Yet another object of the present invention is to provide a new and improved robe squeezer apparatus that is readily used by both right handed and left handed persons.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
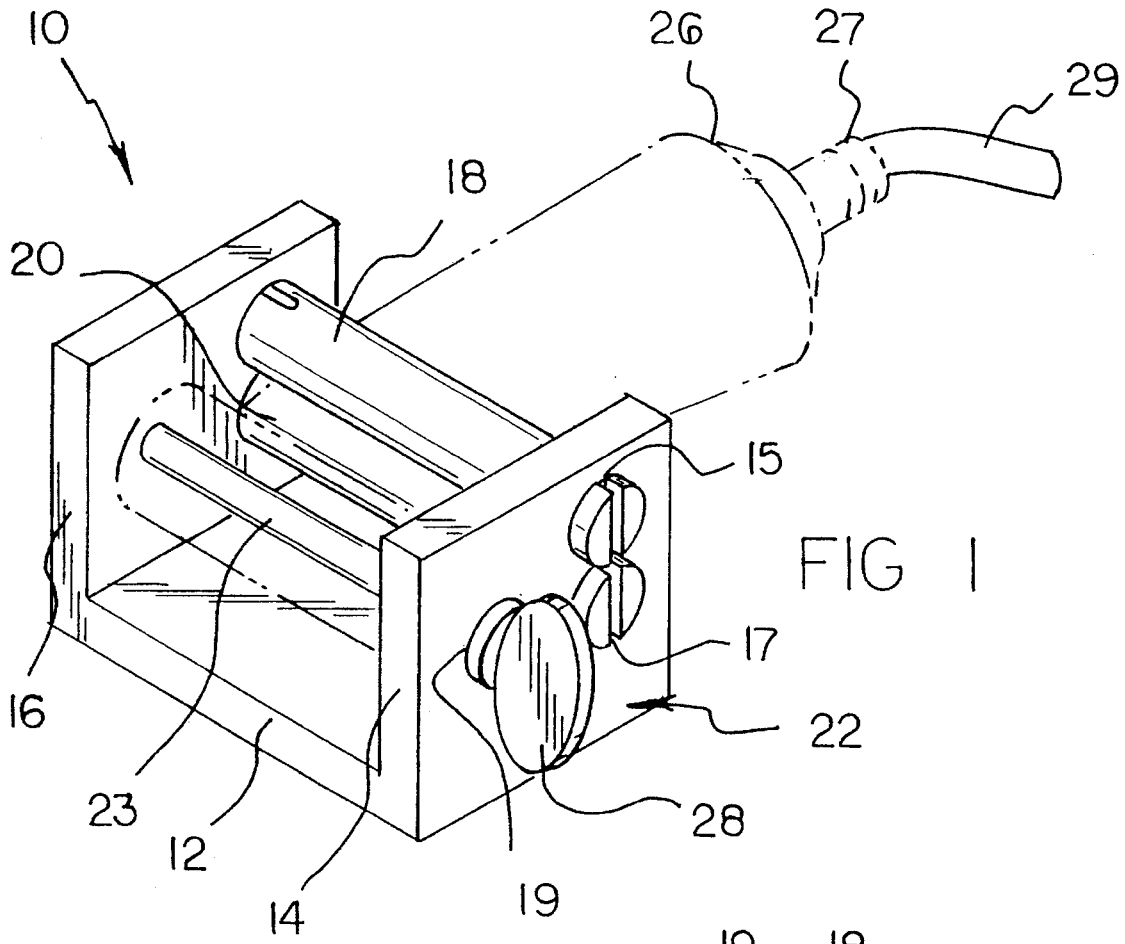
FIG. 1 is a perspective view showing a first preferred embodiment of the tube squeezer apparatus of the invention in use squeezing a squeeze tube.
Figure 2:
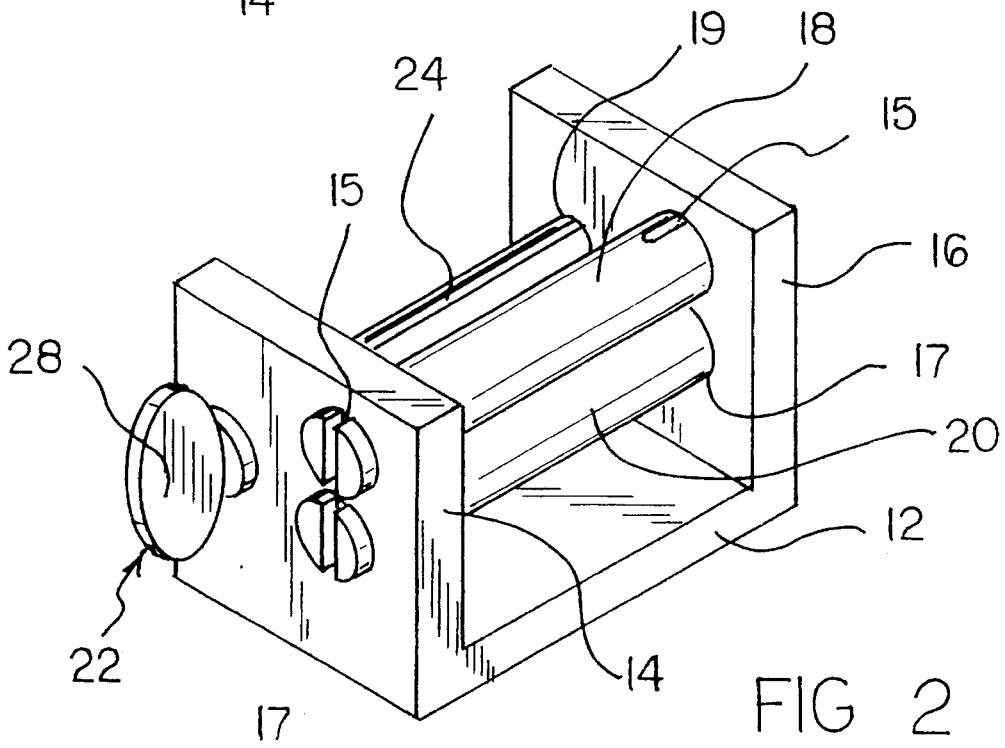
FIG. 2 is another perspective view of the embodiment of the tube squeezer apparatus shown in FIG. 1.
Figure 3:
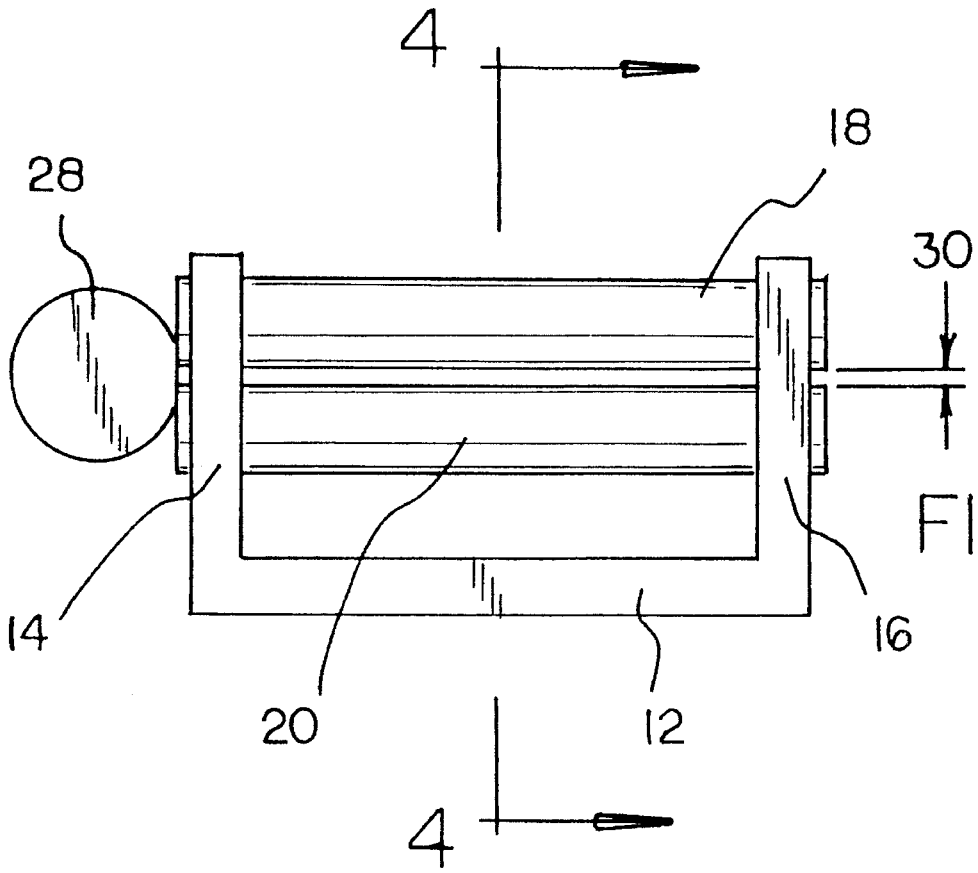
FIG. 3 is a front view of the embodiment of the tube squeezer apparatus of FIG. 2.
Figure 4:
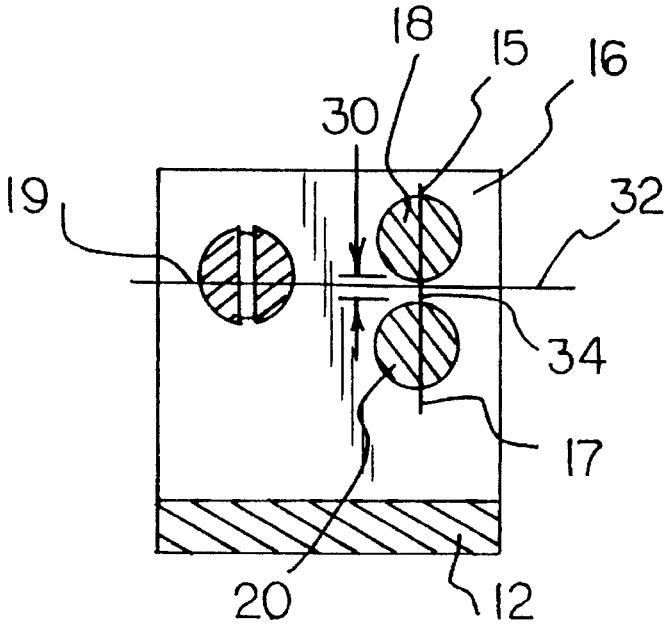
FIG. 4 is a cross-sectional view of the embodiment of the invention shown in FIG. 3 taken along line 4—4 of FIG. 3.

With reference to the drawings, a new and improved tube squeezer apparatus embodying the principles and concepts of the present invention will be described.

Turning to FIGS. 1–4, there is shown a first exemplary embodiment of the tube squeezer apparatus of the invention generally designated by reference numeral 10. In its preferred form, tube squeezer apparatus 10 includes a base member 12 and a first squeezer/winder support member 14 connected to a first side of the base member 12. The first squeezer/winder support member 14 includes a first squeezer connection position 15, a second squeezer connection position 17, and a winder connection position 19. A second squeezer/winder support member 16 is connected to a second side of the base member 12. The first side and the second side of the base member 12 are at opposite sides of the base member 12. The second squeezer/winder support member 16 includes a first squeezer connection position 15, a second squeezer connection position 17, and a winder connection position 19. A first squeezer 18 is connected between the first squeezer connection position 15 of the first squeezer/winder support member 14 and the first squeezer connection position 15 of the second squeezer/winder support member 16. A second squeezer 20 is connected between the second squeezer connection position 17 of the first squeezer/winder support member 14 and the second squeezer connection position 17 of the second squeezer/winder support member 16. The first squeezer 18 and the second squeezer20 include ends for connection to the first squeezer/winder support member 14 and the second squeezer/winder support member 16.

A winder shaft assembly 22 is connected between the winder connection 19 position of the first squeezer/winder support member 14 and the winder connection position 19 of the second squeezer/winder support member 16. The winder shaft assembly 22 includes a shaft portion 23, adapted to support a squeezable tube 26, and a handle 28, connected to the shaft portion 23, for turning the shaft portion 23. The shaft portion 23 includes a slot portion 24 adapted to receive an end of the squeezable tube 26.

The base member 12, the first roller/winder support member 14, and the second roller/winder support member 16 are in the form of a unified, integrated structure. Each of the first squeezer/winder support member 14 and the second squeezer/winder support member 16 includes a squeezer-receiving aperture 44 for receiving an end of the first squeezer 18, a squeezer-receiving aperture 44 for receiving an end of the second squeezer 20, and a winder-receiving aperture 45 for receiving an end of the shaft portion 23 of the winder shaft assembly 22. The squeezer-receiving apertures 44 are circular and provide bearing surfaces for a cylindrical first squeezer 18 and a cylindrical second squeezer 20, thereby permitting the first squeezer 18 and the second squeezer 20 to roll with respect to the first squeezer/winder support member 14 and the second squeezer/winder support member 16. Also, the winder-receiving apertures 45 are circular and provide bearing surfaces for a cylindrical shaft portion 23 of the winder shaft assembly 22 to roll with respect to the first squeezer/winder support member 14 and the second squeezer/winder support member 16 when the handle 28 of the winder shaft assembly 22 is turned.

The first squeezer/winder support member 14 and the second squeezer/winder support member 16 project perpendicularly upward from the base member 12, whereby the first squeezer/winder support member 14 and the second squeezer/winder support member 16 are substantially parallel to each other.

The first squeezer 18 and the second squeezer 20 are spaced apart from each other by a predetermined distance 30 such that a squeezable tube 26 is squeezed between the first squeezer 18 and the second squeezer 20 when the squeezable tube 26 is pulled as it is positioned between the first squeezer 18 and the second squeezer 20. The winder connection position 19 lies on a perpendicular bisector 32 of a line segment 34 between the first squeezer connection position 15 and the second squeezer connection position 17.

Figure 5:
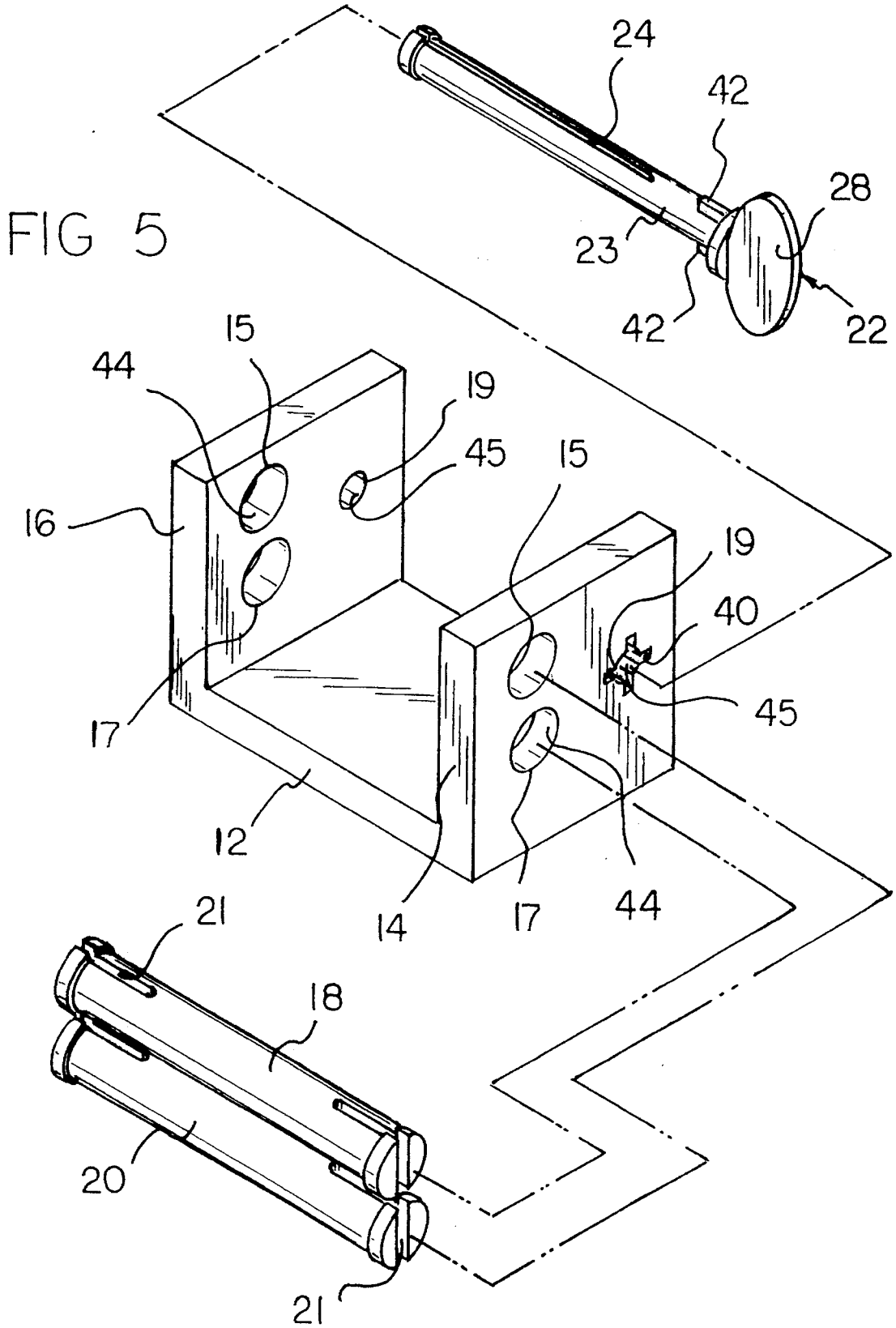
FIG. 5 is an exploded perspective view of a second embodiment of the invention which includes a lock for the winding shaft.

Turning to FIG. 5, a second embodiment of the invention is shown. Reference numerals are shown that correspond to like reference numerals that designate like elements shown in the other figures. In addition, the first squeezer/winder support member 14 includes at least one lock notch 40, and the winder shaft assembly 22 includes at least one lock protuberance 42 adapted to fit into the lock notch 40 for locking the winder shaft assembly 22 in a selected position with respect to the first squeezer/winder support member 14.

More specifically, the first squeezer/winder support member 14 includes a plurality of lock notches 40 arrayed in a circular pattern on the first squeezer/winder support member 14 adjacent to the first squeezer connection position 15 around the shaft portion 23 of the winder shaft assembly 22. The shaft portion 23 of the winder shaft assembly 22 includes a plurality of lock protuberances 42 arrayed in a circular pattern on the shaft portion 23, such that the lock protuberances 42 are adapted to be placed in registration with the lock notches 40.

The respective ends of the first squeezer 18 and the second squeezer 20 include slots 21. The slotted ends 21 of the first squeezer 18 and the second squeezer 20 facilitate retention of the first and second squeezers in the first squeezer/winder support member 14 and the second squeezer/winder support member 16. The portions of the first squeezer 18 and the second squeezer 20 that are adjacent to the slots 21 have a certain degree of resiliency when inserted into the squeezer-receiving apertures 44 of the first squeezer/winder support member 14 and second squeezer/winder support member 16, thereby facilitating retention of the squeezers in the support members. Moreover, the squeezer-receiving apertures 44 provide bearing surfaces on which the first squeezer 18 and the second squeezer 20 may rotate with respect to the first squeezer/winder support member 14 and the second squeezer/winder support member 16.

In operation of the tube squeezer apparatus 10 of the invention, as shown in FIG. 1, an end of a squeezable tube 26, the end opposite to the end in which the outlet 27 is located, is inserted between the first squeezer 18 and the second squeezer 20. Then, the end is in the slot portion 24 of the shaft portion 23 of the winder shaft assembly 22. The handle 28 of the winder shaft assembly 22 is turned so that the end of the squeezable tube 26 winds around the shaft portion 23 of the winder shaft assembly 22. As the end of the squeezable tube 26 winds around the shaft portion 23, the squeezable tube 26 is pulled toward the shaft portion 23 and is squeezed between the first squeezer 18 and the second squeezer 20. As the squeezable tube 26 is squeezed between the first squeezer 18 and the second squeezer 20, the contents 29 of the squeezable tube 26 is squeezed out of the outlet 27 of the squeezable tube 26.

With respect to the embodiment of the invention shown in FIG. 5, to turn the winder shaft assembly 22 with the handle 28, the handle 28 is first grasped to pull the lock protuberances 42 out of the lock notches 40 in which they are placed. The handle 28 is then turned to wind the end of the squeezable tube 26 on the shaft portion 23. Once an desired amount of contents 29 of the squeezable tube 26 is squeezed out of the squeezable tube 26, then the lock protuberances 42 are placed back in registration with and inserted into the lock notches 40. In this way, the interlocking action between the lock protuberances 42 and the lock notches 40 prevents a wound up resilient squeezable tube 26 from unwinding on the winder shaft assembly 22.

To remove a spent squeezable tube 26 from the tube squeezer apparatus 10 of the invention, the winder shaft assembly 22 is pulled out of the first squeezer/winder support member 14 and the second squeezer/winder support member 16, and the portion of the squeezable tube 26 that is wound on the shaft portion 23 of the winder shaft assembly 22 is pushed out of the slot portion 24 of the shaft portion 23 by the first squeezer/winder support member 14. Then, the spent squeezable tube 26 can be pulled out of the tube squeezer apparatus 10 of the invention by pulling the spent squeezable tube 26 away from the tube squeezer apparatus in a direction perpendicular to the first squeezer 18 and the second squeezer 20.

The handle 28 can take many different forms, such as the disk shape in the figures, and the handle 28 can be cylindrical in form and can be an extension of the shaft portion 23 of the winder shaft assembly 22. Whichever form of handle 28 is employed, the tube squeezer apparatus 10 of the invention is readily usable by either right handed or left handed persons.

The components of the tube squeezer apparatus of the invention can be made from inexpensive and durable metal, wood, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved tube squeezer apparatus that is low in cost, relatively simple in design and operation, and which may advantageously be used without being wall mounted. With the invention, a tube squeezer apparatus is provided which does not employ a hand crank. With the invention, a tube squeezer apparatus is provided which does not take up a considerable amount of space and is simple in structure. With the invention, a tube squeezer apparatus is provided which does not employ meshed gears as the tube is squeezed. With the invention, a tube squeezer apparatus is provided which does not require periodic loosening and retightening of flat plates against a flat base. With the invention, a tube squeezer apparatus is provided which is readily usable with resilient plastic squeeze tubes. With the invention, a tube squeezer apparatus is provided which locks a winding shaft supporting a partially squeezed tube into a partially squeezed position to prevent the resilient squeeze tube from unwinding on the winding shaft. With the invention, a tube squeezer apparatus is provided which is readily used by both right handed and left handed persons.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A tube squeezer apparatus, comprising:

a base member, a first squeezer/winder support member connected to a first side of said base member, said first squeezer/winder support member including a first squeezer connection position, a second squeezer connection position, and a winder connection position, a second squeezer/winder support member connected to a second side of said base member, wherein said first side and said second side of said base member are at opposite sides of said base member, wherein said second squeezer/winder support member includes a first squeezer connection position, a second squeezer connection position, and a winder connection position, a first squeezer connected between said first squeezer connection position of said first squeezer/winder support member and said first squeezer connection position of said second squeezer/winder support member, a second squeezer connected between said second squeezer connection position of said first squeezer/winder support member and said second squeezer connection position of said second squeezer/winder support member, wherein said first squeezer and said second squeezer include ends for connection to said first squeeze/winder support member and said second squeezer/winder support member, and a winder shaft assembly connected between said winder connection position of said first squeezer/winder support member and said winder connection position of said second squeezer/winder support member, wherein said winder shaft assembly includes a shaft portion, adapted to support a squeezable tube, and a handle, connected to said shaft portion, for turning said shaft portion, wherein said shaft portion includes a slot portion adapted to receive an end of the squeezable tube, wherein said first squeezer/winder support member includes a plurality of lock notches arrayed in a circular pattern on said first squeezer/winder support member adjacent to said first squeezer connection position around said shaft portion of said winder shaft assembly, and wherein said shaft portion of said winder shaft assembly includes a plurality of lock protuberances arrayed in a circular pattern on said shaft portion, such that said lock protuberances are adapted to be placed in registration with said lock notches.

2. The apparatus of claim 1 wherein said base member, said first squeezer/winder support member, and said second squeezer/winder support member are in the form of a unified, integrated structure.

3. The apparatus of claim 1 wherein each of said first squeezer/winder support member and said second squeezer/winder support member includes:

a squeezer-receiving aperture for receiving an end of said first squeezer, a squeezer-receiving aperture for receiving an end of said second squeezer, and a winder-receiving aperture for receiving an end of said shaft portion of said winder shaft assembly.

4. The apparatus of claim 3 wherein said squeezer-receiving apertures of said first squeezer/winder Support member and said second squeezer/winder support member are circular and provide bearing surfaces for a cylindrical first squeezer and a cylindrical second squeezer, thereby permitting said first squeezer and said second squeezer to roll with respect to said first squeezer/winder support member and said second squeezer/winder support member.

5. The apparatus of claim 3 wherein said winder-receiving apertures of said first squeezer/winder support member and said second squeezer/winder support member are circular and provide bearing surfaces for a cylindrical shaft portion of said winder shaft assembly to roll with respect to said first squeezer/winder support member and said second squeezer/winder support member when said handle of said winder shaft assembly is turned.

6. The apparatus of claim 1 wherein said first squeezer/winder support member and said second squeezer/winder support member project perpendicularly upward from said base member, whereby said first squeezer/winder support member and said second squeezer/winder support member are substantially parallel to each other.

7. The apparatus of claim 1 wherein said first squeezer and said second squeezer are spaced apart from each other by a predetermined distance such that a squeezable tube is squeezed between said first squeezer and said second squeezer when the squeezable tube is pulled as it is positioned between said first squeezer and said second squeezer.

8. The apparatus of claim 1 wherein said winder connection position lies on a perpendicular bisector of a line segment between said first squeezer connection position and said second squeezer connection position.

9. The apparatus of claim 1 wherein said respective ends of said first squeezer and said second squeezer include slots.

* * * * *